US005879203A

United States Patent [19]

Egle et al.

[11] Patent Number: 5,879,203

[45] Date of Patent: Mar. 9, 1999

[54] FUSE HOLDER CLIP

[75] Inventors: Edward R. Egle, Arlington; Robert A. Nimmo, Schaumburg, both of Ill.

[73] Assignee: Micron Industries Corporation, Hillside, Ind.

[21] Appl. No.: 790,765

[22] Filed: Jan. 27, 1997

[51] Int. Cl.[6] ..... H01K 11/22

[52] U.S. Cl. ..... 439/830; 439/73

[58] Field of Search ..... 439/737, 339, 439/830–833

[56] References Cited

U.S. PATENT DOCUMENTS

| | | | |
|---|---|---|---|
| 734,407 | 7/1903 | Downese | 439/830 |
| 2,422,589 | 6/1947 | Samzelius | 439/739 |
| 3,744,003 | 7/1973 | Dipace | 439/830 |
| 4,176,906 | 12/1979 | Urani | 439/830 |
| 4,950,195 | 8/1990 | Perreault et al. | 439/830 |

*Primary Examiner*—Hien Vu
*Attorney, Agent, or Firm*—Wallenstein & Wagner, Ltd.

[57] ABSTRACT

A fuse clip is described for securing a fuse to a base and making electrical contact with fuse terminals, comprising a U-shaped contact clip having a bight portion positioned between two opposing legs. The bight portion, which provides a surface adjacent to the base, is initially arched away from the base and has an aperture to receive a fastening member for securing the contact clip to the base. Upon tightening the fastening member and securing the clip to the base, the fastening member causes the bight portion to flatten and the legs to be drawn towards one another. Thus, upon fastening, the legs are drawn from an initially extended position to a more contracted position.

4 Claims, 1 Drawing Sheet

FUSE HOLDER CLIP

DESCRIPTION

Technical Field

The present invention relates generally to fuse clips and specifically to a one-piece fuse clip that is arranged with a second, complementary fuse clip to secure a cartridge-type electrical fuse upon being secured to a base.

Background Prior Art

It is known in the art to use fuse clips for introducing a fuse in an electrical circuit. Conventional fuse clips have two leg portions, with each leg shaped to conform to, and thereby secure, a cartridge fuse. As is well known in the art, a cartridge fuse is comprised of a cylindrical body having two terminals, one on each end. Therefore, a pair of fuse clips are typically required to support the fuse; one fuse clip supports each terminal. Such fuse clips are disclosed, for example, in U.S. Pat. Nos. 2,292,320; 2,422,589; 2,889,533; 4,176,906 and 4,472,018.

U.S. Pat. No. 2,422,589, issued to Samzelius, discloses a two-piece, fuse clip assembly having a contact clip and an adjustable reinforcing member. The contact clip conforms to and makes electrical contact with the fuse. The reinforcement member is U-shaped, enveloping each side of the contact clip, as discussed below. A bight portion separates the two legs of the reinforcement member. The bight portion is positioned laterally beyond the contact clip and the end of a fuse. Each leg extends upward from the bight portion and is L-shaped to extend over each side of the contact clip. In one embodiment, the bight portion of the reinforcement member is flat. Two flanges extend laterally from the contact clip to support the edges of the bight portion of the reinforcement member, leaving a gap underneath the middle of the bight portion. In a second embodiment, the middle of the bight portion is arched upwards, so the edges of the bight portion directly contact the base instead of being supported underneath by flanges. In both embodiments, a threaded fastener attaches the reinforcement member to a base through an aperture in the center of the bight portion. When the fastener is tightened, the bight portion is flexed downwardly, which draws the legs of the reinforcement member inwardly. As a result, the reinforcement member applies pressure to the contact clip. With the fuse positioned in the fuse clip, the fastener then can be adjusted to vary the pressure that the reinforcement member applies to the contact clip. Samzelius does not disclose a single-piece fuse clip having legs that are drawn inwardly. Rather, Samzelius discloses a two-piece fuse clip assembly having a contact clip and a reinforcement member. Also, the lateral extension of the reinforcement member prevents fuse clip disclosed in Samzelius from fitting in a terminal bay of an electrical transformer. Consequently, the fuse clip disclosed in Samzelius would be unsuitable for installing a fuse directly to an electrical transformer.

SUMMARY OF THE INVENTION

The present invention is provided to solve the above identified and other problems. It is an object of the present invention to provide a fuse clip for securing a fuse to a base and making electrical contact with fuse terminals. The fuse clip comprises a U-shaped contact clip having a bight portion positioned between two opposing legs. The bight portion provides a surface adjacent to the base and has an aperture to receive a fastening member for securing the contact clip to the base. The bight portion is initially arched away from the base, while the legs are initially spread apart a sufficient distance to accommodate the head of a fastener between the legs. Upon tightening the fastening member and securing the clip to the base, the fastening member causes the bight portion to flatten and the legs to be drawn towards one another. Once the fuse clip is fastened to the base, the distance between the legs becomes more narrow than the head of the fastener, but the distance between the legs is proper to accommodate the fuse.

For a better understanding of the invention, reference may be had to the following detailed description taken in conjunction with the following drawings. Furthermore, other features and advantages of the invention will be apparent from the following detailed description taken in conjunction with the following drawings.

DETAILED DESCRIPTION

Figure 1:
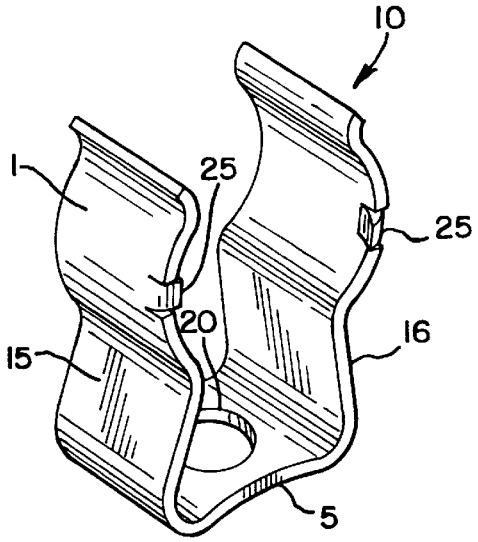
FIG. 1 is an elevational view of a preferred embodiment of the fuse clip according to the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 4:
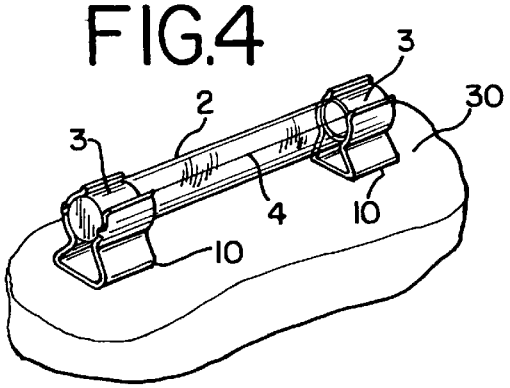
FIG. 4 is an elevational view of two fuse clips engaging a typical cartridge-type fuse.

FIG. 4 illustrates a fuse clip 10 for securing a fuse 2 to a base 30 and making electrical contact with fuse terminals 3. As is well known in the art, a fuse 2, such as a cartridge-type fuse, is introduced into an electrical circuit by using two fuse clips 10. Such cartridge fuses are typically cylindrically shaped, having a terminal 3 on each end and containing a fuse filament 4 between each terminal 3, 3. The fuse is disposed between, and supported by two fuse clips 10, 10 so that each fuse clip 10 makes electric contact with a respective fuse terminal 3.

Figure 2:
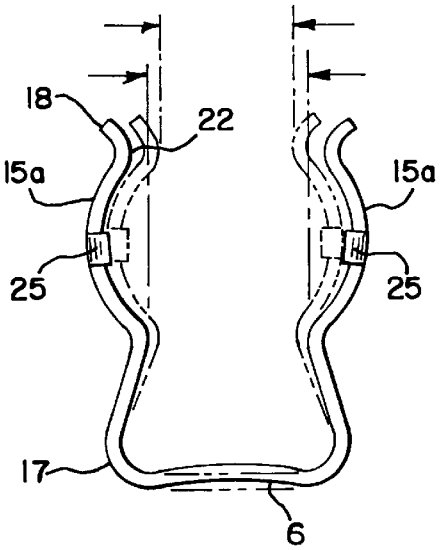
FIG. 2 is a side plan view of the preferred embodiment of the protective cover illustrated in FIG. 1 showing the fuse clip in both the initial and secured positions.
Figure 3:
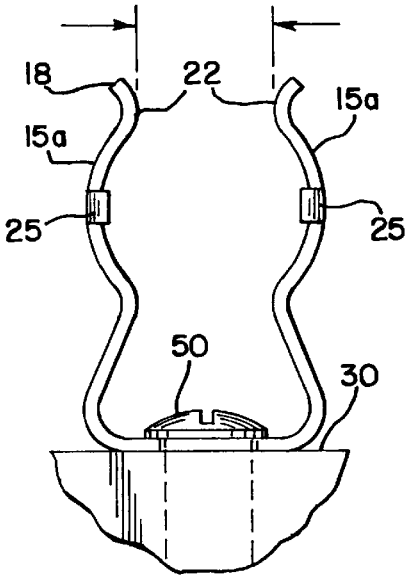
FIG. 3 is a side plan view of the preferred embodiment of the fuse clip, illustrated in FIG. 1, shown as secured to a base by a fastener.

Turning to FIG. 1, a U-shaped contact clip 1 has a bight portion 5 positioned between two opposing legs 15, 15. As shown in FIGS. 2 and 3, in the initial position, the legs 15, 15 are spaced apart with sufficient distance to accommodate a fastening member 50, as will be discussed below. The bight portion 5 provides a surface 6 adjacent to the base 30.

The bight portion 5 is initially arched away from the base 30 and has an aperture 20 to receive a fastening member 50 for securing the contact clip to the base 30. In the preferred embodiment, the legs 15,15 are spread apart a sufficient distance to unobstructively accommodate a fastener 50, such as, a fastener for electrical connections having a number 10 head and a number 8 thread. Upon tightening the fastening member 50 and securing the contact clip to the base 30, the fastening member 50 causes the bight portion 5 to flatten and the legs 15, 15 to be drawn towards one another. Once the fuse clip 10 is secured to the base 30, the legs 15, 15 are spaced apart a distance more narrow than the diameter of the head of a fastener 50, as illustrated in FIG. 3.

In the preferred embodiment, the contact clip 1 is formed from a resilient material. Each leg 15, 15 includes a fuse-holding section 15a, 15a contoured to cooperatively receive the fuse 2, as illustrated in FIG. 4. Each leg 15, 15 of the contact clip 1 is provided with a respective tab 25, 25 for centering the fuse while the fuse is being retained by two opposing fuse clips 10, 10, as illustrated in FIG. 4. As illustrated in FIGS. 2 and 3 each tab 25, 25 extends substantially perpendicularly from the respective leg 15, 15.

Each leg 15, 15 of the fuse clip 10 has a first end 17 integrally extending from the bight portion 5 and a second end 18 cantilevered opposite the first end 17. As illustrated in FIGS. 1–3, the second end 18 of each leg 15, 15 is bent away from the opposing leg 15, 15, creating a bent portion 22 for providing a surface to slidably engage and remove the fuse 2.

Figure 5:
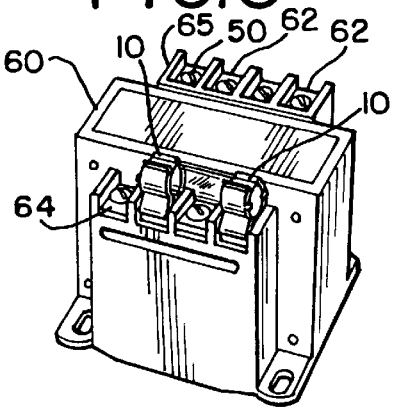
FIG. 5 is an elevational view of two fuse clips fastened on a typical electrical transformer.

In one application, illustrated in FIG. 5, two fuse clips 10, 10 are connected to a terminal block 65 of an electrical transformer 60. A typical transformer 60 has a plurality of terminal bays 62, each containing a terminal 64 and fastener 50, arranged in a row. As seen in FIG. 5, one fuse clip 10 is fastened to a terminal bay 62 on the terminal block 65 by a terminal fastener 50 and the other fuse clip 10 is likewise fastened to another terminal bay 62. Once installed, a fuse 2, such as the one illustrated in FIG. 4, is installed between the two fuse clips 10, 10.

In conclusion, it will be understood that the invention may be embodied in other specific forms without departing from the spirit or central characteristics thereof. The present example and embodiment, therefore, is to be considered in all respects as illustrative and not restrictive, and the invention is not to be limited to the details given herein. Therefore, the scope of protection is only limited by the scope of the accompanying claims.

We claim:

1. A fuse holder for securing a fuse to a base and making electrical contact with fuse terminals, comprising:

first and second single U-shaped contact clips, each clip formed from a resilient material having a bight portion and first and second opposing legs extending upwardly from said bight portion, said legs integrally formed from said bight and having upper sections with a circular contour to conform to a contour of the fuse terminals;

the bight portion having an aperture to receive a fastening member for securing the contact clip to the base and having a first position extending arcuately away from the base;

where upon tightening the fastening member and securing the clip to the base, the fastening member causes the bight portion to have a second position wherein the bight portion is flatly secured to the base and the legs are drawn toward one another to secure the fuse.

2. The fuse clip of claim 1, wherein the contact clip is provided with a tab extending substantially perpendicularly from each leg for centering the fuse while the fuse is being retained by the fuse clip.

3. The fuse clip of claim 1, wherein each leg has a first end integrally extending from the bight portion and a second end cantilevered opposite the first end.

4. The fuse clip of claim 3, wherein the second end of each leg is bent away from the opposing leg, creating a bent portion for providing a surface to slidably engage and remove the fuse.

* * * * *